United States Patent [19]

Terlecky

[11] Patent Number: 4,636,119

[45] Date of Patent: Jan. 13, 1987

[54] ALL PURPOSE RAILROAD CAR

[75] Inventor: Boris S. Terlecky, Woodridge, Ill.

[73] Assignee: Trailer Train Company, Chicago, Ill.

[21] Appl. No.: 653,821

[22] Filed: Sep. 24, 1984

[51] Int. Cl.[4] ..... B61D 45/00

[52] U.S. Cl. ..... 410/54; 410/56; 410/76; 105/226

[58] Field of Search ..... 410/54, 56, 57, 60, 410/62, 63, 64, 71, 76; 105/159, 182 R, 197 R, 226, 228, 4 R

[56] References Cited

U.S. PATENT DOCUMENTS

| | | | |
|---|---|---|---|
| 3,250,232 | 5/1966 | Aquino et al. | 410/54 |
| 3,357,371 | 12/1967 | Gutridge | 410/54 |
| 3,568,607 | 3/1971 | Gutridge | 410/54 |
| 3,805,709 | 4/1974 | Schuller et al. | 410/54 |
| 3,854,423 | 12/1974 | Bridge | 410/54 |
| 4,227,843 | 10/1980 | Damm | 410/54 |
| 4,274,776 | 6/1981 | Paton et al. | 410/57 |
| 4,516,506 | 5/1985 | Paton | 410/57 X |

*Primary Examiner*—Randolph A. Reese
*Assistant Examiner*—Glenn B. Foster
*Attorney, Agent, or Firm*—Robert V. Jambor

[57] ABSTRACT

An all purpose railroad car for transporting trailers and containers, having an elongated frame adapted to be supported by wheel trucks, combined hitch and container bolster means adjacent one end of the car frame for selectively receiving and releasably retaining a trailer king pin and one end of a container, and means spaced from the combined hitch and container bolster means for selectively receiving and supporting the wheels of a trailer and the other end of a container. The car may be a light-weight skeletal frame including an elongated center sill, wheel trucks at opposite ends of the center sill supporting said center sill, each wheel truck including a single axle. Cushioning means may be provided between the combined hitch and container bolster means and the frame operable to oppose longitudinal movement of the lading relative to the frame.

36 Claims, 10 Drawing Figures

26
85
92
88
90
97
74
73
98
77
82
94
27
101
81
23
86
99
84
83
9
71
72
95
87
100
75
25
93
79
78
91
89
76
96
29
94

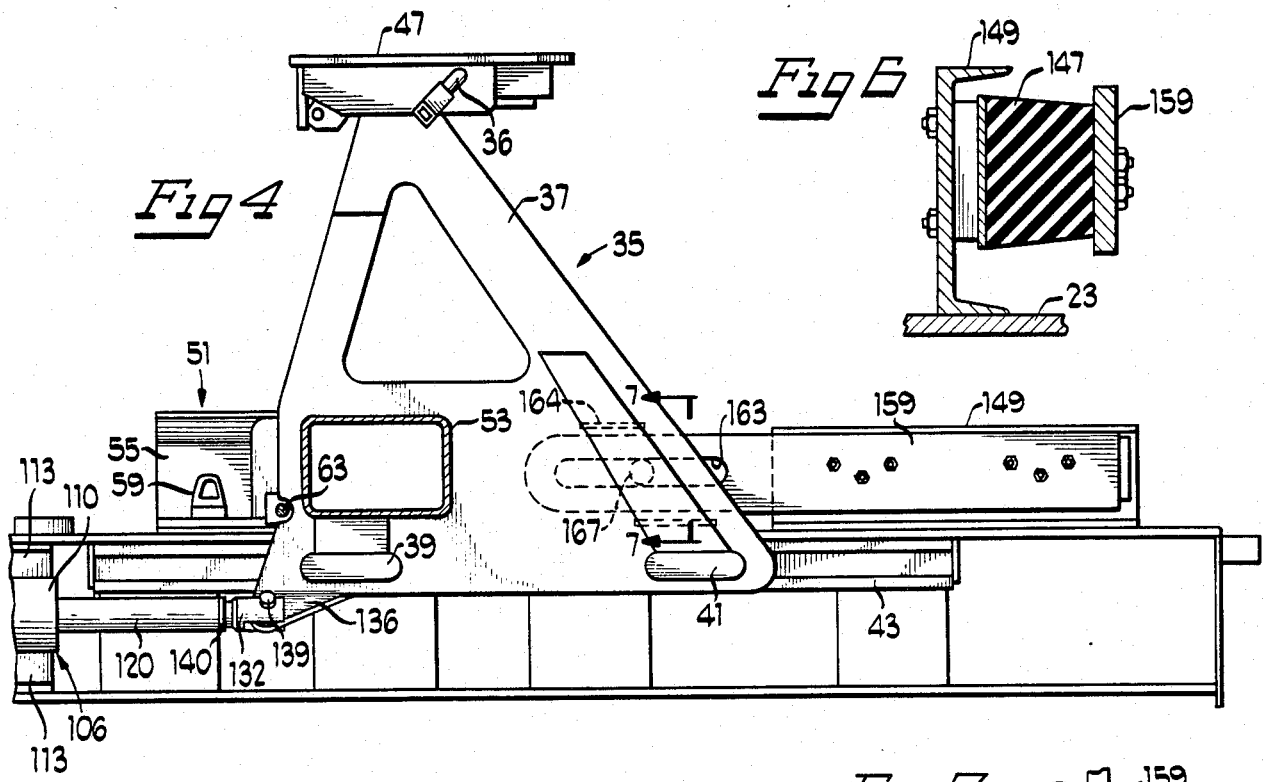
Fig 4
47
36
37
35
51
55
59
113
110
63
53
164
7
163
159
149
39
167
41
43
136
120
140
132
139
106
113
Fig 6
149
147
159
23
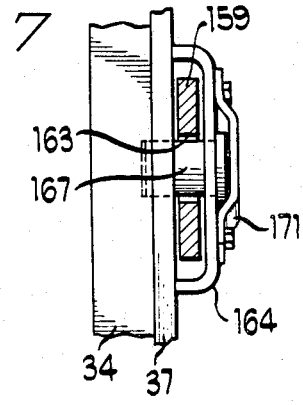
Fig 7
159
163
167
171
164
34
37
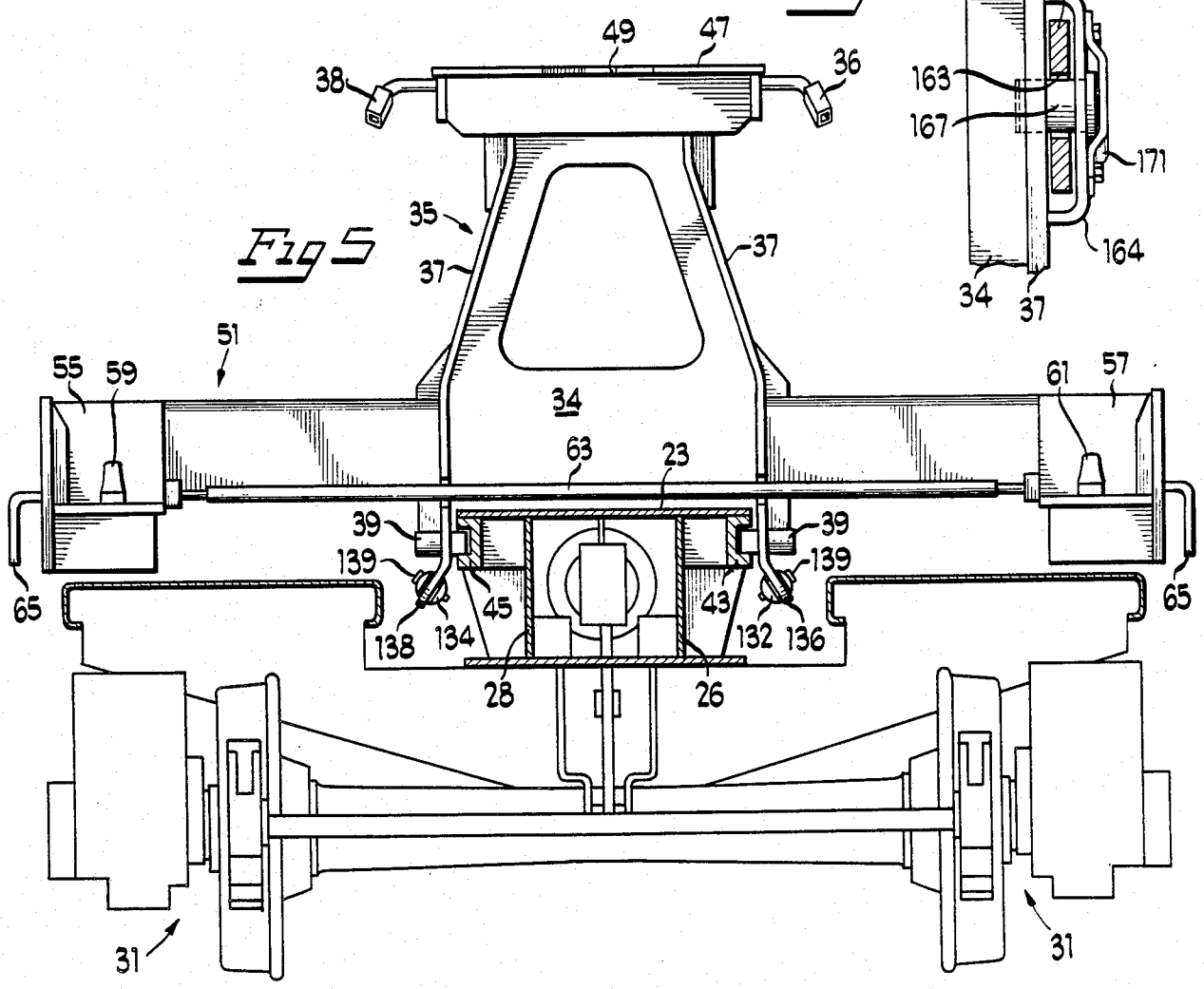
Fig 5
49
47
38
36
35
37
37
51
55
59
34
61
57
63
23
39
39
139
139
65
65
45
43
138
134
132
136
28
26
31
31

ALL PURPOSE RAILROAD CAR

BACKGROUND OF THE INVENTION

This invention relates to railroad cars, and more particularly to light weight, fuel efficient, all purpose railroad cars for transporting lading including wheeled vehicular trailers and containers.

Railroad cars are used to transport lading. The most common types of lading transported in this fashion are wheeled vehicular trailers and containers. The trailers are normally of the type which are adapted for attachment to a powered vehicular tractor by a king pin and fifth wheel connection. The containers are generally large rectangular-shaped bodies with reinforced bottom corners adapted to receive releasable locking pins which hold the containers in place. In both cases, the trailers and containers are positioned on and releasably secured to a railroad car, and are removed therefrom when the car reaches its destination.

Many railroad cars are constructed to handle either trailers or containers. All purpose cars, i.e., those which can accommodate both trailers as well as containers, have been constructed but, in most cases, are cumbersome, complicated and expensive at least partially because of the construction provided for support and retention of wheeled vehicular trailers and box-like containers. One example, which requires collapsible hitches and a container support cradle or frame, is found in U.S. Pat. No. 3,183,853 to Terlecky et al. issued May 18, 1965. Such all purpose cars are generally large and heavy and require expensive constructions. They are also costly to operate.

Another important consideration in railroad cars of this type is the requirement for cushioning of the lading to minimize damage as a result of impact to the car. Importantly, it is desirable that such railroad cars be constructed to meet industry standards such as AAR cushioning specifications.

Accordingly, it is desirable to provide an all purpose railroad car capable of use in transporting wheeled vehicular trailers as well as rectangular containers, which car is relatively inexpensive and light weight and can utilize single axle wheel trucks. Furthermore, it is desirable that such an all purpose car construction employ relatively simple and low-cost cushioning means which achieves or exceeds industry cushioning objectives.

SUMMARY OF THE INVENTION

The present invention satisfies the requirements described above by providing a low-cost, light weight all purpose railroad car adapted to transport wheeled vehicular trailers and rectangular containers. The railroad car of this invention is adapted for ready transport of either trailers or containers and is capable of accommodating containers of different sizes. The car is provided with novel cushioning means for the lading which comports with industry standards. In its preferred form, the car is of light weight skeletal construction, with single axle trucks. It is intended to carry one container or one trailer and accepts either form of lading in varying lengths up to the most modern trailers. The railroad car of this invention achieves a minimum of weight and cost and provides for reliable, safe and fuel efficient operation.

Advantages of the present invention will be set forth in part in the description which follows, and in part will be apparent from the description, or may be learned by practice of the invention. The advantages of the invention may be realized and attained by means of the instrumentalities and combinations particularly pointed out in the appended claims.

In accordance with the invention, as embodied and broadly described herein, the railroad car of this invention is an all purpose car for transporting trailers and containers, the car comprising an elongated frame adapted to be supported by wheel trucks, combined hitch and container bolster means adjacent one end of the car frame for selectively receiving and releasably retaining a trailer king pin and one end of a container, and means spaced from the combined hitch and container bolster means for selectively receiving and supporting the wheels of a trailer and the other end of a container.

In another aspect, the present invention relates to an all purpose railroad car for transporting trailers and containers, the car comprising a light-weight skeletal frame including an elongated center sill, wheel trucks at opposite ends of the center sill supporting said center sill, each wheel truck including only a single axle with wheels at opposite ends thereof, a combined hitch and container bolster means supported on the center sill at one end thereof and including a hitch for receiving and retaining a trailer king pin and a bolster for receiving and retaining one end of a container, platform means on opposite sides of the center sill at the other end thereof and adapted to support wheels of a trailer, and the other end of a container.

In yet another aspect, the present invention relates to an all purpose railroad car for transporting lading including trailers and containers, and comprises an elongated frame, combined hitch and container bolster means at one end of the frame for movement longitudinally thereof, the hitch including means for selectively receiving and retaining a trailer king pin, and the bolster including means for selectively receiving and releasably retaining one end of a container, means on said frame spaced from said combined hitch and container bolster adapted to support the wheels of a trailer and the other end of a container, and cushioning means between the combined hitch and container bolster means and the frame operable to oppose longitudinal movement of the lading relative to the frame.

Preferably, the combined hitch and bolster means is mounted on the frame for longitudinal movement relative thereto, and the cushioning means includes first and second cushioning means, one of which is preloaded and operable to bias the combined hitch and bolster means toward a neutral position and to cushion and lading in both longitudinal directions of movement relative to the frame. The second cushioning means includes lost motion means and is operable to cushion the lading in both directions of longitudinal movement relative to the car after a predetermined amount of travel has occurred therebetween.

The invention, in any of its forms, may include moveable container support means to support the free end of a container, that is, the end which is not releasably secured to the combined hitch and bolster means. The moveable container support means is unattached to the container which is, therefore, slidable thereon. Further, the container support means is positionable longitudinally of the frame to accommodate containers of differing length and positionable to an inactive position to adapt the car for placement thereon of a wheeled trailer.

The accompanying drawings, which are incorporated in and constitute a part of this specification, illustrate an embodiment of the invention, and together with the description, serve to explain the principles of the invention.

BRIEF DESCRIPTION OF THE DRAWINGS

FIG. 4 is a sectional view of FIG. 2 taken along the line 4—4 thereof;

FIG. 5 is a sectional view of FIG. 2 taken along the line 5—5 thereof;

FIG. 6 is an enlarged sectional view of FIG. 2 taken along the line 6—6 thereof;

FIG. 7 is an enlarged sectional view of FIG. 4 taken along the line 7—7 thereof;

DESCRIPTION OF THE PREFERRED EMBODIMENT

Figure 1:
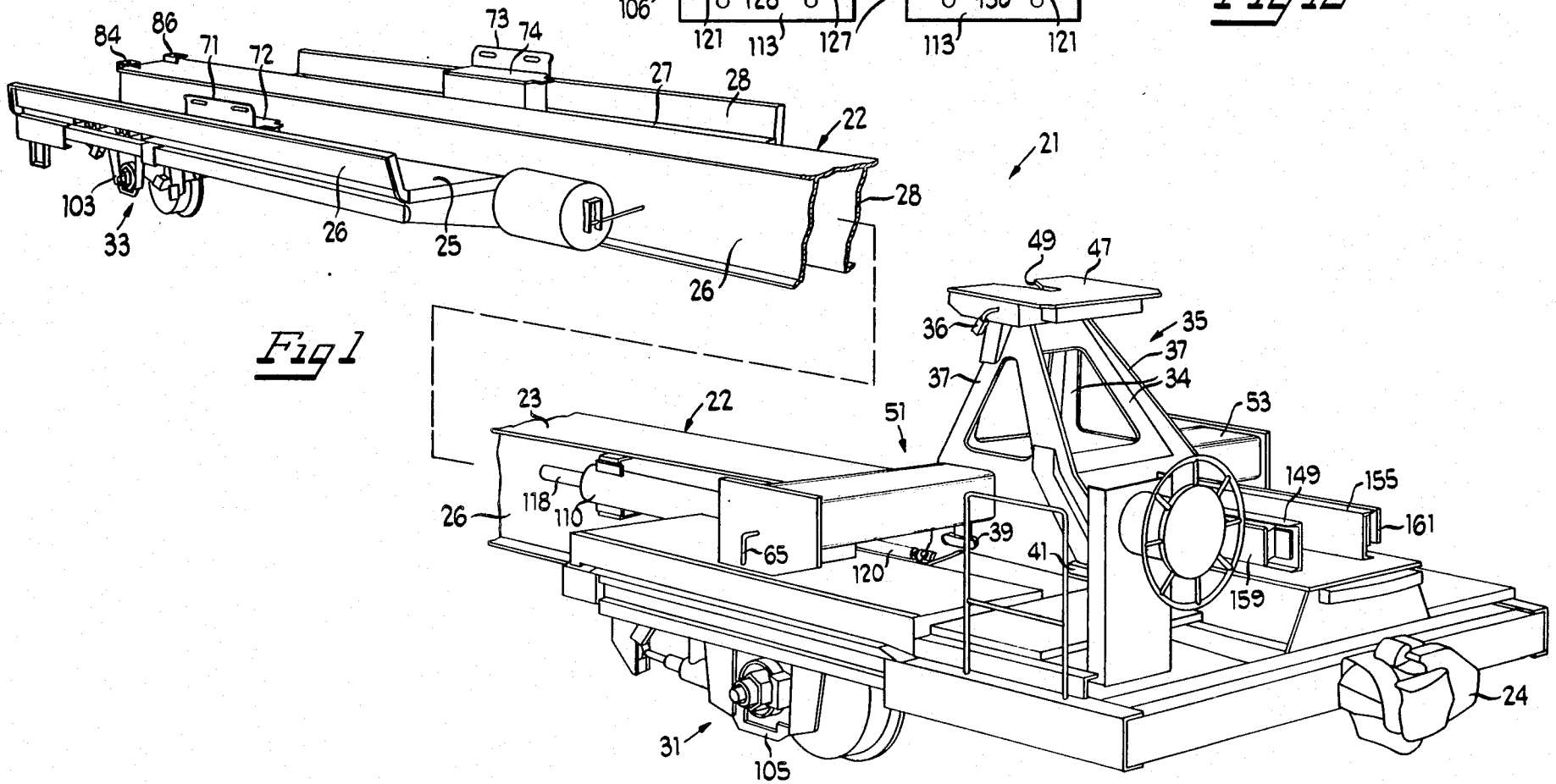
FIG. 1 is a perspective view illustrating an all purpose railroad car embodying the principles of the invention.

A preferred embodiment of all purpose railroad car of this invention, generally, 21, is shown in FIG. 1. It comprises a light-weight, elongated skeletal frame adapted to be supported at each end by single axle wheel trucks. The truck arrangement may be configured as illustrated in the application for United States letters patent filed contemporaneously herewith by Rene H. Brodeur, Boris S. Terlecky and Gerald R. Misner, entitled Brake System and assigned to the common assignee. That application, now U.S. Pat. No. 4,596,311, is incorporated by reference herein. The car may also be of the type shown in copending application for U.S. Pat. Ser. No. 597,642 filed Apr. 6, 1984 now U.S. Pat. No. 4,589,558 by Brodeur and Terlecky, also incorporated by reference herein. In its broadest form, the inventive concept of the present invention is applicable to any form of railroad car intended for trailer and container transport.

As embodied herein, the car 21 comprises an elongated frame 22 in the form of a main structural center sill 23 supported adjacent opposite ends by wheel trucks 31, 33. Couplers 24 at opposite ends couple the car to adjacent cars. Platform means, best seen in FIGS. 1 and 3 including a pair of deck plates 25, 27, are provided on opposite sides of the center sill 23, in this embodiment adjacent the rear end of the car. They are secured to the center sill 23 by suitable means such as by welding and supported by suitable cross members 29 best seen in FIG. 9. The deck plates 25, 27 extend laterally of the center sill, and are positioned below the top of the center sill 23. They are provided with outboard upstanding side plates 26, 28 as will be discussed further below.

The car 21, of this invention, is constructed and used in transporting wheeled vehicular trailers and containers of the type which are constructed for attachment to a powered tractor for over-the-road transportation. These trailers and containers are illustrated in U.S. Pat. No. 3,183,853 previously identified. The trailers include wheels at one end and a king pin at the other end, the latter being constructed for attachment to a fifth wheel plate assembly on a highway tractor. Such wheeled vehicular trailers are adapted to be positioned on the car 21 with the wheels supported on the deck plates 25, 27. Side plates 26, 28 and center sill 23 confine the trailer wheels laterally, and the plates 25, 27 are positioned as low as possible to the ground to maintain the center of gravity of the car 21 and carried trailer also as low as possible. The trailer is loaded onto and off the car 21 by means of a crane in the conventional manner as is understood by those skilled in the art.

In accordance with the invention, combined hitch and bolster means generally designated 35 is provided adjacent one end of the car main center sill 23 spaced from deck plates 25, 27. It includes a trailer hitch for receiving and retaining a trailer king pin and a bolster for receiving and retaining one end of a container. As embodied herein, combined hitch and bolster means includes reinforced, generally triangular-shaped struts 37 slidably supported on each side of the center sill 23 by way of front and rear pairs of slides 39, 41 (FIGS. 1 and 5). The pairs of slides ride in tracks 43, 45 fixed to the center sill 23. The struts 37 are connected together by transverse webs 38 to form an integral and rigid combined hitch and bolster means structure.

A mounting plate 47, sometimes referred to as a fifth wheel plate, is fixed to the top of struts 37. The plate 47 is provided with an entry slot 49 for guidably receiving the trailer king pin and includes locking jaws (not shown) for securing the king pin in place to connect the trailer to the combined hitch and bolster means. The jaws (not shown) are operated to lock and release the king pin 34 by turning either of a pair of operating levers 36, 38 in a conventional manner as will be understood by those skilled in the art. Thus, with the trailer wheels on the deck plates 25, 27 and the king pin locked to the plate 47, the vehicular trailer is supported and releasably retained in place on the car 21.

In accordance with the invention, the combined hitch and bolster means 35 also includes a container bolster for supporting and releasably retaining one end of a container. As embodied herein, a container bolster 51 includes a rectangular shaped tube 53 which extends through and is secured to the struts 37 such as by welding and substantially spans the width of the car 21 (see FIGS. 1 and 2). A pair of container support brackets 55, 57 are fixed one at each end of the tube 53 at the side thereof facing wheel platforms 25, 27, by suitable means such as by welding. The brackets 55, 57 are constructed to support and confine the front corners of a rectangular container such as a container shown in U.S. Pat. No. 3,183,853. Locking projections 59, 61 extend upwardly through the bottom of the brackets 55, 57, respectively, for reception in openings conventionally formed in the bottom of the containers. A twist lock device including a rotatable operating rod 63 having manually operable handles 65, at opposite sides of the car 21 can be turned in opposite directions to twist or turn the locking projections 59, 61 to lock and release a container to the bolster. In the position of the projections 59, 61 shown in FIG. 2, the projections are aligned so as to be accepted within openings conventionally formed in corner brackets of the containers so that in this position, a container can be placed on, or removed from, the bolster. With a container on the bolster and the projections 59, 61 turned 90° relative to the position shown in FIG. 2, the container is releasably locked to the bolster. Details of the structure connecting the rod 63 and the projections 59, 61 are not shown but are conventional and understood by those skilled in the art.

It will be appreciated that by combining the container bolster with the trailer hitch on a unitary, rigid structure, a simple, compact, and inexpensive all purpose car is provided. As here disclosed in the preferred embodiment the car 21 is light weight and skeletal. The principles and advantage of the invention incorporated in the combined hitch and bolster are, of course, adaptable to any form of railroad car. Other important advantages as well flow from this novel construction, as will be described below.

In accordance with the invention, container support means are provided on the frame 22 for supporting the end of a container remote from the end releasably secured to the bolster support brackets 55 and 57. It is contemplated that the containers merely rest on and are unattached to the container support means. Further, the container support means are adjustable longitudinally of the frame 22 to accommodate containers of different length. The supporting means are also movable to an inactive position to accept a trailer positioned on the car. The support means are moveable but cannot be removed from the frame.

Figures 3, 8, 9:
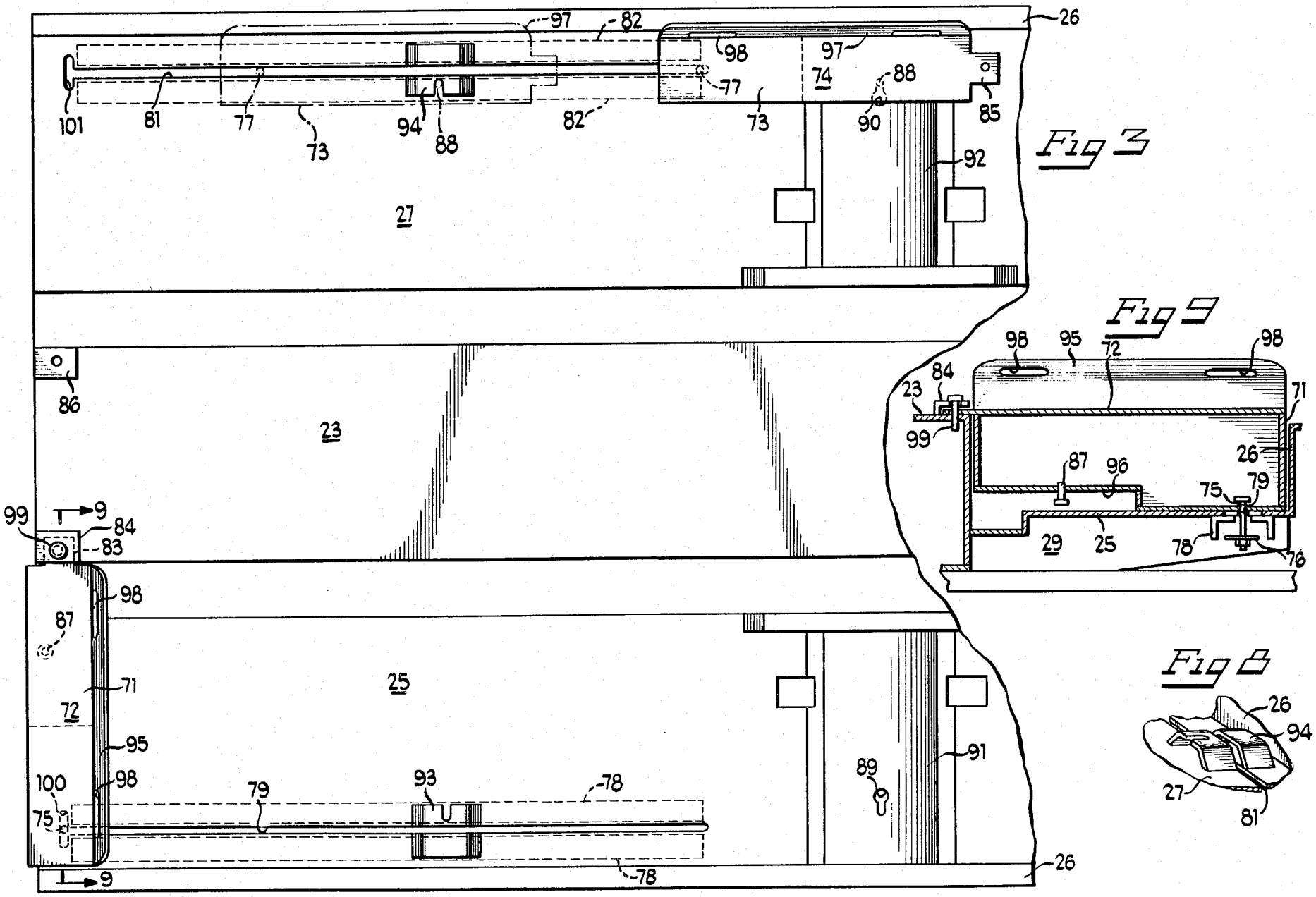
FIG. 3 is an enlarged top plan view of the rearward portion of FIG. 1.
FIG. 8 is an enlarged perspective view of a portion of the structure shown in FIG. 3.
FIG. 9 is a sectional view of FIG. 3 taken along the line 9—9 thereof.

As embodied herein, a pair of open ended supports 71, 73 defining horizontal planer surfaces 72, 74 are mounted on the deck plates 25, 27, respectively (see FIGS. 1, 3 and 9). As seen in FIG. 9, an elongated bolt 75 extends through the bottom of the support 71 and through an elongated slot 79 in the deck plate 25 so that the support 71 can be adjusted longitudinally of the plate 25. Washer 76 prevents withdrawal of the bolt 75 through slot 79. If necessary, strengthening bars such as angle channels 78 may be welded to the under side of the deck plate to provide strength adjacent the slot 79. The bolt 75 also allows the support 71 to pivot relative to the deck plate 25 but prevents its removal. The bolt is elongated to permit limited vertical movement of the container supports for reasons as will become apparent. Similarly, an elongated bolt 77 extends through the bottom of support 73 and an elongated slot 81 in deck plate 27 so that the support 73 can move longitudinally of and pivot relative to plate 27 but cannot be removed therefrom. Channels 82 may be provided to strengthen plate 27 adjacent slot 81.

Containers come in different, although standard lengths such as 40 feet and 45 feet. These containers are customarily formed with strengthened corner brackets with previously described locking device receiving openings. Conventionally such containers are fixed at each corner to a railroad car for rail transport. When removed, they may be placed in a stacked array for ship transport, or connected to a wheel assembly and fifth wheel assembly for over-the-road hauling. For stacking, and other reasons of compatability 45 foot containers also normally include reinforcement and connection means along each longitudinal bottom edge two and one-half feet inboard of the transverse ends of the container. The 45 foot container can be stacked upon and connected to a 40 foot container and also, can be connected to other carrying devices which are provided with latches at the 40 foot spacing.

When the supports 71, 73 are positioned lengthwise of the car frame 22, as shown for support 73 in FIG. 3, they are in position to support the rear end of a container, i.e., the end opposite the end supported and releasably retained on the bolster 51. To accept containers of different length, the supports 71, 73 are adapted to be positioned in at least two positions lengthwise of the deck plates 25, 27 to provide support of the free end of such containers adjacent the areas of the bottom longitudinal edges. Thus for carrying a 40 foot container the supports 71, 73 would both be positioned as is support 73 shown in full lines in FIG. 3. The 40 foot container would be supported upon supports 71, 73 at its corners.

To support a 45 foot container, supports 71, 73 are moved to the position shown for support 73 in dotted lines. That position is 2 ½ feet from the first described position. The 45 foot container as well as the 40 foot container is connected to brackets 55, 57 of bolster 51 at its corners. Therefore, the portions of a 45 foot container which rest on surfaces 72, 74 of container supports 71, 73 are the reinforced bottom edges located 2 ½ feet inboard of the free end of the container.

Means are provided to releasably secure the container support means in the two active positions illustrated. As embodied herein, the supports 71, 73 are provided with locking pins 87, 88, respectively, which extend downwardly thereof (see support 71 and pin 87 in FIG. 9). The pins 87, 88 are adapted to slidably fit into slotted openings formed in or on deck plates 25, 27, respectively. In the construction shown, the deck plates 25, 27 include arcuately and upwardly curved hump 91, 92 to accommodate the wheels of the railroad trucks disposed below the deck plates. This permits location of the deck plates at as low a possible location relative to the center sill and provides a low center of gravity for the wheeled trailers.

In the illustrated embodiment, one set of slotted openings is formed as key slots 89, 90 in the humps 91, 92. The bottoms of supports 71, 73 are stepped, as shown at 96, for support 71 in FIG. 9, to accommodate humps 91, 92. The other set of slotted openings is provided by raised slotted channels 93, 94 suitably fixed to the deck plates 25, 27, respectively, with the slots disposed at the same vertical height as the slots 89, 90. As can be appreciated, to position container supports 71, 73 nearest humps 91, 92, it is necessary that they pass over channels 93, 94. This is accomplished by virtue of elongated bolts 75, 77 which permit lifting of the supports 71, 73, over the channels without removal of the bolts 75, 77 from slots 79, 81.

It will be appreciated that when the supports 71, 73 are positioned with their locking pins 87, 88 fitted in slotted openings, as described above, and a container is resting on the top of the supports, the locking pins will not be permitted to exit the slotted openings. To assist here, and to help contain lateral movement of the container free end, the supports 71, 73 have upwardly extending flanges 95, 97, respectively, at their outboard sides which, when a container is resting on surfaces 72, 74, prevents movement of the container supports 71, 73 inward, toward the center sill. Each flange 95, 97 has openings 98 for manual manipulation of the supports 71, 73.

Also, it will be understood that the container merely rests upon upper flat surfaces 72, 74 of the container. The container is therefore slidable upon the supports. Connection of the container only to bolster 51 at brackets 55, 57, simplifies the construction and allows for ease in positioning, connection and removal of the container.

Containers of various length are in each instance positioned on bolster 51 at brackets 55, 57. Depending on container length, the container supports 71, 73 are positioned either in the position of support 73 shown in solid lines in FIG. 3 with pins 87, 88 disposed in key slots 89, 90 of platform humps 91, 92, or the position of support 73 shown in position in FIG. 3 with pins 87, 88 disposed in the slots of channels 93, 94. It is understood that to support the free or unconnected end of a container both supports 71, 73 are positioned parallel to the longitudinal extent of the center sill 23.

Container support means 71, 73 are movable to an inactive position when a wheeled trailer is positioned on the car. As embodied herein, supports 71, 73 can be moved to the rearward extent of the deck plates 25, 27 as allowed by slots 79, 81 and as shown for support 71 in FIG. 3. The supports may then be pivoted to a position substantially transversely of the car. In this position, the supports 71, 73 are completely out of the way of the trailer wheels and allow trailers to be freely loaded and unloaded on the car.

Supports 71, 73 can be locked in the inactive position by inserting tabs 83, 85 on the supports into recesses formed by channels 84, 86 on the center sill 23, and then inserting pins 99 through openings in the channels 84, 86 and tabs 83, 85. The elongated slots 79, 81 in deck plates 25, 27 are provided with lateral portions 100, 101 at their rearward ends to facilitate manipulation of the supports 71, 73 into this position.

In its preferred form, the all purpose car embodying this invention comprises a light-weight skeletal construction which allows the car to be used with single axle wheel trucks. As embodied herein and described above, the car 21 includes a frame formed by an elongated center sill 23 supported at each end by wheel trucks 31, 33 through truck suspension frames 103, 105 and springs, as will be understood by those skilled in the art.

This construction minimizes the weight of the car 21 to maximize fuel economy while providing an all purpose car construction capable of transporting a trailer or a container. Importantly, this light-weight skeletal frame construction described above allows the use of single axle wheel trucks 31, 33 at each end of the car 21, each having only a single axle and a pair of wheels at opposite ends. This further minimizes the weight and cost of the car 21 and the power and fuel required to transport it.

In accordance with the preferred form of the invention, cushioning means is provided between the combined hitch and container bolster means and the car frame 22. The cushioning means is operable to cushion the carried lading by permitting longitudinal movement thereof on the car. The illustrated cushioning means includes first cushioning means operable to bias the combined hitch and bolster means toward a neutral position and to cushion the lading longitudinally in both directions of movement relative to the car, and second cushioning means including, lost motion means, operable to cushion the lading in both directions of movement after a predetermined amount of travel has occurred between the lading and the car frame 22. The second cushioning means preferably has a higher spring rate than the first and becomes effective or operative only near the end of the travel of the lading.

Figure 10:
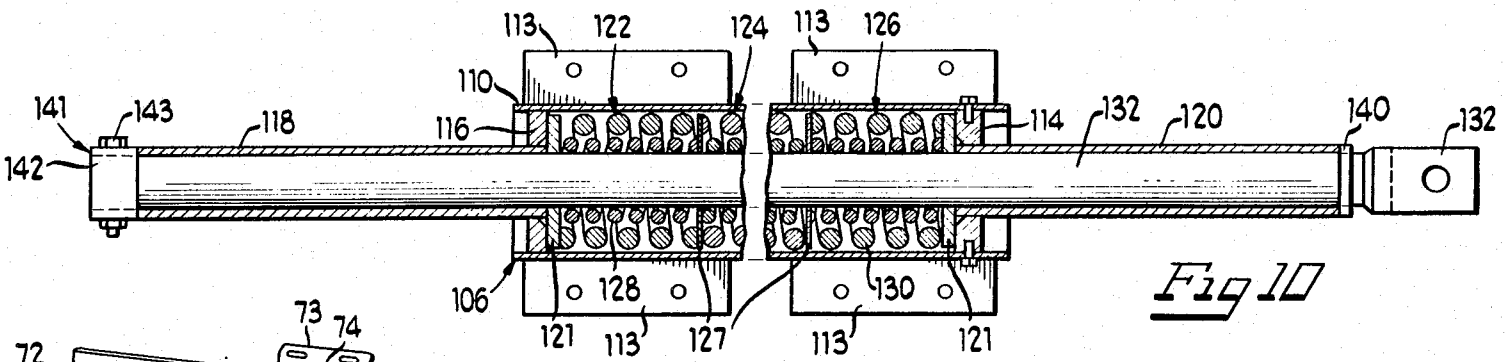
FIG. 10 is a sectional view of FIG. 2 taken along the line 10—10 thereof.
Figure 2:
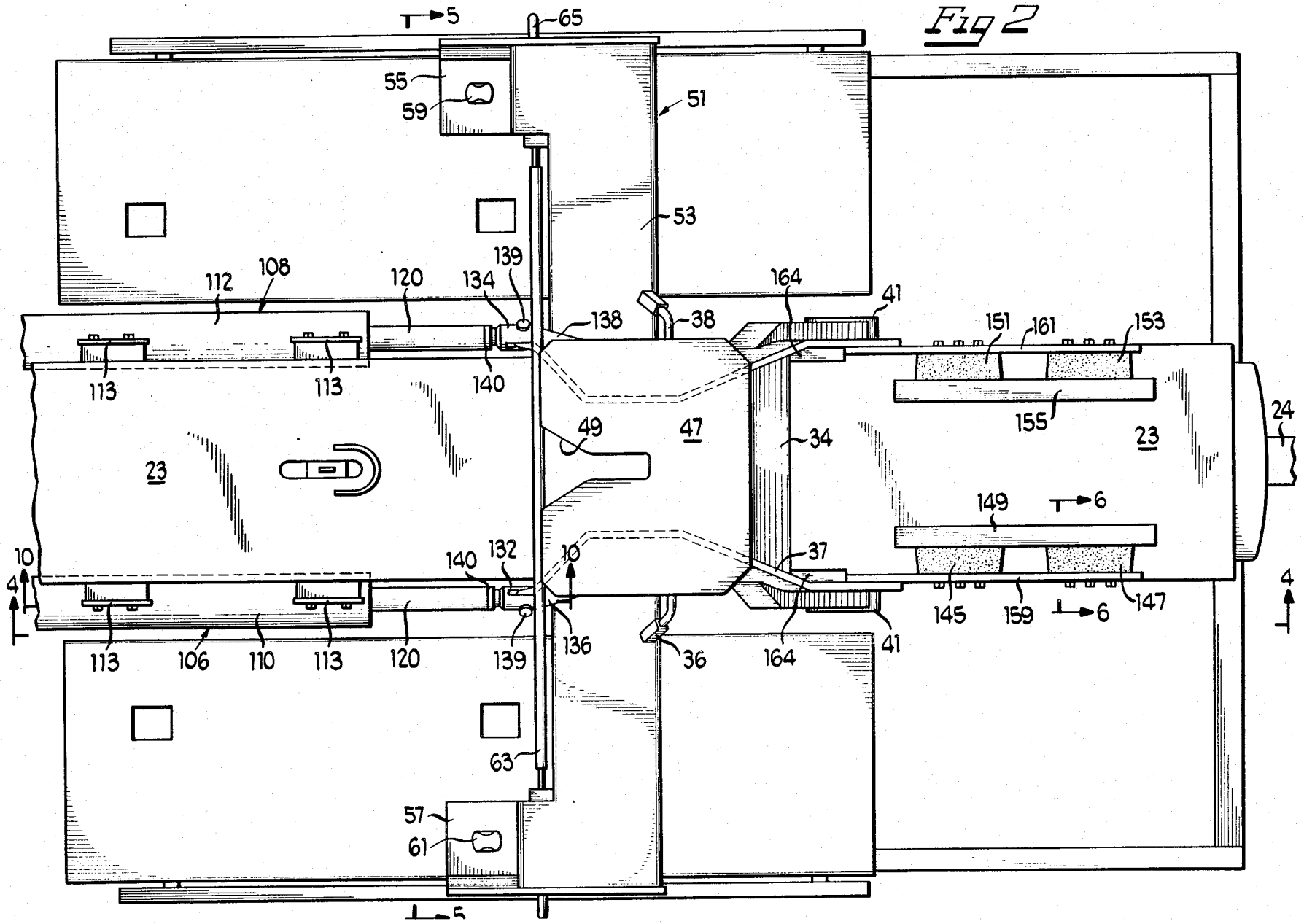
FIG. 2 is an enlarged top plan view of the forward portion of FIG. 1.

As embodied herein, first cushioning means 106, 108 best seen in FIGS. 2, 4 and 10 are spring loaded cushioning devices which store energy by mechanical compression of springs. These cushioning devices include tubular housings 110, 112, fixed to opposite sides of center sill 23 by brackets 113.

As best seen in FIG. 10, housings 106, 108 include annular end caps or collars 114, 116, at opposite ends which are fixed to the tubular housings 110, 112. End caps 114 are removably secured to tubular housings 110, 112 for reasons as will become apparent.

Slidably retained within tubular housings 110, 112, are hollow sleeves 118, 120 which are longitudinally elongate and include flanges 121 which abut end collars 114, 116 within each tubular housing 110, 112.

As illustrated, a plurality of sets of compression coil springs 122, 124, 126 are positioned between flanges 121 of sleeves 118, 120 within each tubular housing 110, 112, which urge the flanges, and hence the hollow sleeves 118, 120 respectively in opposite directions toward opposite end caps 114, 116. Spacers 127, may be provided between each set of coil springs, which in the illustrated embodiment each include internal springs 128 and external spring 130.

Cushioning devices 106 and 108 further include actuator shafts 132, 134 connected by bolts 139 respectively to webs 136, 138 integrally formed on struts 37. Each includes an enlarged collar 140 adjacent the connection to webs 136, 138, to coact with the exposed ends of sleeve 120 as will be explained. The shafts 132, 134 respectively extend through sleeves 118, 120, of cushioning devices 106, 108 and include free ends 141 which extend beyond the exposed ends of sleeves 118 as best seen in FIG. 10. A removable collar 142 is secured by a bolt 143 to each one of shafts 132, 134 external to sleeve 118 of each cushioning device 106, 108. The collar is sized to coact with the exposed ends of sleeve 118.

Cushioning devices 106, 108 are assembled to provide a pre-load or restoring force upon the combined hitch container and bolster means 35 to maintain it in a neutral or nominal position relative to center sill 23. End caps 116 are fixed to tubular members 110, 112 as by welding. End caps 114 are removable. With the caps 114 removed, sleeves 120 and spring sets 122, 124, 126 may be placed within the tubular housings 110, 112. The sleeves 118 are then added to the assembly and spring sets 122, 124, 126 compressed by external means until end caps 114 can be positioned within, secured to the tubular housings 106, 108. This pre-loads the springs between flanges 121 of sleeves 118 and 120 with the spring force urging sleeves 118 and 120 apart and respectively toward end caps 114, 116.

The free ends 141 of shafts 132, 134 are respectively passed through sleeves 120, 118 and spring sets 126, 124, 122 until collar 140 of each shaft contacts the exposed end of sleeves 120. When so positioned free ends 140 are exposed beyond sleeves 118 and removable collars 142 are secured with bolts 143 to complete the assembly. The shafts 132, 134 are then connected to webs 136, 138 of the combined hitch and bolster means 35 and the tubular housings 110, 112 are secured respectively to opposite sides of center sill 23 with brackets 113.

As further embodied herein, the second cushioning means includes a plurality of spaced rubber blocks 145, 147 fixed at one side to a channel 149 which is secured to the top of the center sill 23, and a plurality of spaced rubber blocks 151, 153 fixed at one side to another channel 155 also secured to the top of the center sill 23 (see FIGS. 2, 4 and 6). The other sides of the rubber blocks 145, 147 and 151, 153 are fixed to operating arms 159, 161, respectively. The operating arms 159, 161 are provided with elongated slots 163 (only one of which is shown), which slidably receive pins 167 fixed to the struts 37. Operating arms 159, 161 are slidably guided between the struts 37 and channels 164 fixed to opposite sides of the struts, and the pins 167 are removably held in place on the struts 37 by detachable plates 171. (See FIG. 6)

Impact of railroad car 21 occurs through its couplers 24 and the resultant forces are transmitted to the center sill 23. The cushioning means are intended to limit transfer of those impact forces to the carried lading. AAR (Association of American Railroads) standards provide that upon a ten mile per hour impact to a coupler, forces transmitted to a king pin of a trailer should not exceed 210,000 pounds. These standards further provide that upon a ten mile per hour impact, forces transmitted to a container should not exceed 130,000 pounds. By appropriate sizing of springs 122, 124, 126 and shear pads 145, 147, 151, 153, the objectives of these standards may be accomplished with the present invention.

Initial compression of springs 122, 124, 126 urges sleeves 118, 120 of each device to the outermost extent as illustrated in FIG. 10. Engagement of collar 140 with sleeves 120 and collar 142 with sleeves 118 fixes the nominal or neutral position of shafts 132, 134. The shafts, in turn, through connection with webs 136, 138, position slidable struts 37 centrally of the permissible travel of slides 39, 41 within tracks 43, 45. Impact to one of the couplers 24 causes longitudinal forces to be imparted to the frame 22 in one or the other direction. The lading in the form of a trailer or container connected to combined hitch and bolster means is, of course, separated from those forces by the cushioning means. The cushioning means operates through shafts 132, 134 to compress springs 122, 124, 126, within tubular housings 110, 112. If the impact is in one direction, collars 140 urge sleeves 120 toward sleeves 118 in each cushioning device to compress the springs and cause longitudinal movement of the car 21 relative to the combined hitch and bolster means and connected lading. If the impact is from the opposite direction, collars 140 coact with sleeves 118 to force those sleeves toward sleeves 120 and again compress the spring set and permit longitudinal movement. Regardless of direction, compression of the springs increases the forces available to restore the active sleeves and consequently the shafts 132, 134 to the nominal position. This dissipates the impact forces and protects the trailer and container cargo.

As described above, relative longitudinal motion between the struts 37 of the combined hitch and bolster means 35 and the car 21 is initially cushioned by the compression springs in the housings 110, 112 acting on the shafts 132, 134. Once a predetermined amount of travel has occurred between the struts 37 and the car 21, as allowed by pins 167 riding in slots 163, the pins 167 reach the ends of the slots 133. At this point, continued movement of the struts 37 relative to the car 21 causes the operating arms 159, 161 to move longitudinally relative to the center sill 23, which loads the rubber blocks 145, 147 and 151, 153 in shear. The spring rate of the rubber blocks is somewhat higher than that of the compression springs so that movement of the struts 37, and consequently the combined hitch and bolster means is quickly halted.

A light-weight, fuel efficient car such as that illustrated, embodying the present invention, varies in weight between 27,000 pounds to 35,000 pounds. Loaded trailers, or containers may weigh up to 60,000 to 70,000 pounds. It is contemplated that a pre-load on cushioning devices 106, 108 in the range of 10,000 pounds to 20,000 pounds will be sufficient to restore shafts 132, 134, and hence the combined hitch and bolster means 35, to the nominal or neutral position after an impact. It is further contemplated that spring rates sufficient to build the restoring forces imparted to the combined hitch and bolster means to 60,000 to 70,000 pounds will provide lading protection at acceptable levels.

It is contemplated the travel of the combined hitch and bolster means against the forces of primary cushioning units 106, 108 and cushioning shear blocks 145, 147, 151 and 153 is in the range of between about 10 inches and 20 inches. The secondary shear blocks become active by engagement of pins 167 in lost motion slots 163 after about 3 inches to 6 inches of travel. It is contemplated that combined spring and rubber shear block forces will build to 25,000 pounds to 30,000 pounds upon maximum travel of the combined hitch and bolster means.

It will be appreciated that by providing the cushioning means on the struts 37 which is a rigid element of both the trailer hitch and the container bolster, the cushioning means serves to cushion both types of lading. The cushioning of this invention is thus easily constructed to protect lading in trailers or containers within AAR cushioning standards.

While a preferred embodiment of the present invention has been illustrated and described above in detail, it will be understood by those skilled in the art that various additions, substitutions, modifications and omissions may be made thereto without departing from the scope or spirit of the invention. Thus, it is intended that the present invention encompass those additions, substitutions, modifications and omissions provided they come within the scope of the appended claims.

Without limiting the scope of the inventive concept disclosed, various modifications are contemplated to take advantage of the broad principles of the invention. For example, any suitable form of cushioning device may be interposed between the center sill and combined hitch and bolster means. Further or alternative cushioning could be provided by incorporation of a conventional cushioned hitch as an element of the combined hitch and bolster means.

A variety of alternative arrangements may be utilized to support the free ends of containers positioned upon the railroad car. For example, pivotably mounted means might be used which swing up from under the wheel platform at appropriate positions to support containers of various lengths. The combined hitch and bolster could, in an alternative arrangement, be connected directly upon a railroad car which has cushioned couplers. Two such units could be provided on a single car to provide multiple lading carrying capacity.

What is claimed is:

1. An all purpose railroad car for transporting wheeled trailers and containers, said car comprising an elongated frame supported by wheel trucks, combined hitch and bolster means adjacent one end of said frame for selectively receiving and releasably retaining a trailer king pin and one end of a container and means spaced from said combined hitch and bolster means for selectively receiving and supporting the wheels of a wheeled trailer and the other end of a container, and wherein said combined hitch and bolster means is an integral rigid structure with said hitch fixed in spaced relationship to said bolster with both said hitch and said bolster permanently disposed in operative position to respectively receive and retain a trailer king pin and a container.

2. A car as claimed in claim 1 wherein said combined hitch and bolster means includes a hitch to releasably receive and retain a trailer king pin and a bolster extending transversely of the frame terminating at opposite ends in corner support brackets to receive and releasably retain the corners of one end of a container, and wherein said combined hitch and bolster means includes reinforced, generally triangular-shaped struts connected together by transverse webs to form said integral rigid structure, a mounting plate fixed to the top of said struts defining a fifth wheel plate, and said bolster including a tube secured to said struts.

3. The car claimed in claim 1, said means for supporting the other end of a container comprising container support means spaced from said combined hitch and bolster means defining a pair of spaced apart planar surfaces to support a container thereon and being adjustable longitudinally of said frame to accommodate containers of different length.

4. The car claimed in claim 3, including means on said container support means and said frame engagable for releasably securing said container support means in at least two longitudinally adjusted positions.

5. The car claimed in claim 3, said container support means spaced from said combined hitch and bolster means being movable to an inactive position.

6. The car claimed in claim 3, said container support means including a pair of supports each defining a planar supporting surface to support a container thereon and said supports being slidably secured to said frame for movement longitudinally thereof to accommodate containers of different length.

7. The car claimed in claim 6, said frame and said container support including cooperative means adapted to interengage to releasably secure said supports in at least two longitudinally spaced operative positions to support a container thereon.

8. The car claimed in claim 7, said frame including a longitudinal centersill, said means for supporting the wheels of a wheeled trailer comprising deck plates on opposite sides of said center sill, said deck plates each having a longitudinally extending slot formed therein, said container supports including bolt means adapted to extend into respective ones of said slots, whereby said supports can be adjusted longitudinally of said centersill.

9. The car claimed in claim 8, wherein said container supports each include upstanding flanges adjacent said planar surfaces, disposed parallel to said centersill when said container supports are in position to permit disposition of a container between said flanges on said planar surfaces.

10. The car claimed in claim 8, said cooperative means on said container support means and said frame including projections on said container supports and transverse slot defining means on said deck plates to receive said projections.

11. The car claimed in claim 1, wherein said combined hitch and bolster means is movable longitudinally relative to said frame, and cushioning means interposed between said combined hitch and bolster means and said frame is operable to cushion lading in the trailer or container against longitudinal forces imparted to said frame.

12. The car claimed in claim 11, said cushioning means including staged first and second cushioning means, said first cushioning means being operable to bias said combined hitch and bolster means toward a neutral position and to cushion said combined hitch and bolster means in both directions of movement longitudinally relative to said frame, said second cushioning means including lost motion means whereby to cushion said combined hitch and bolster means in both directions of movement longitudinally relative to said frame only after a predetermined amount of relative movement therebetween.

13. The car claimed in claim 12, said second cushioning means including rubber blocks fixed to said frame and to means connected to said combined hitch and bolster means and adapted to deflect in shear after said predetermined amount of relative movement.

14. The car claimed in claim 12, said first cushioning means including compression spring means interposed between said frame and said combined hitch and bolster means.

15. The car claimed in claim 14, wherein said first cushioning means includes a pair of cushioning devices defining hollow tubular housings secured to said frame, coacting shafts connected to said combined hitch and bolster means and compression springs interposed between said hollow tubular housings and said shafts to compress said springs upon either direction of movement of said combined hitch and bolster means.

16. The car as claimed in claim 15 wherein said cushioning devices each include annular end caps at opposite ends thereof, hollow sleeve members with flanged ends disposed internally of said tubular member, said sleeve members extending outwardly of said tubular member through said annular end portions and terminating in free ends external thereto, spring means disposed intermediate said flanges on said sleeves urging said sleeves toward said end caps, each one of said coacting shafts extending through said tubular member, sleeve members, and spring means and terminating adjacent opposite ends in a collar, each said collar being cooperable with one of said sleeve members on impact to said frame to urge said sleeve member toward the other sleeve member within said tubular member to compress said springs between said internal flanges on said sleeve members.

17. A car as claimed in claim 11, wherein said cushioning means includes a pair of cushioning devices defining hollow tubular housings secured to said frame, coacting shafts connected to said combined hitch and bolster means and compression springs interposed between said hollow tubular housings and said shafts to compress said springs upon either direction of movement of said combined hitch and bolster means.

18. The car as claimed in claim 17 wherein said cushioning devices each include annular end caps at opposite ends thereof, hollow sleeve members with flanged ends disposed internally of said tubular member, said sleeve members extending outwardly of said tubular member through said annular end portions and terminating in free ends external thereto, spring means disposed intermediate said flanges on said sleeves urging said sleeves toward said end caps, each one of said coacting shafts extending through said tubular member, sleeve members, and spring means and terminating adjacent opposite ends in a collar, each said collar being cooperable with one of said sleeve members on impact to said frame to urge said sleeve member toward the other sleeve member within said tubular member to compress said springs between said internal flanges on said sleeve members.

19. A car as claimed in claim 11, wherein said frame includes tracks mounted thereon and said combined hitch and bolster means includes slides slidably received within said tracks.

20. An all purpose railroad car for transporting trailers and containers, the car comprising a light-weight skeletal frame including an elongated center sill, wheel trucks at opposite ends of the center sill supporting said center sill, each wheel truck including only a single axle with wheels at opposite ends thereof, a combined hitch and container bolster means supported on the center sill at one end thereof and including a hitch for receiving and retaining a trailer king pin and a bolster for receiving and retaining one end of a container, platform means on opposite sides of the center sill at the other end thereof and adapted to support wheels of a trailer, and the other end of a container, and wherein said combined hitch and bolster means is an integral rigid structure with said hitch fixed axially in a spaced relationship to said bolster along the center sill such that a container retained by said bolster is spaced axially from said hitch said hitch and said bolster permanently disposed in operative position to respectively receive and retain a trailer king pin and a container.

21. A car as claimed in claim 20 wherein said bolster extends transversely of the frame terminating at opposite ends in corner support brackets to receive and releasably retain the corners of one end of a container.

22. The car claimed in claim 21, said means for supporting the other end of a container, comprising container support means spaced from said combined hitch and bolster means defining a pair of spaced apart planar surfaces to support a container thereon and being adjustable longitudinally of said center sill to accommodate containers of different length.

23. The car claimed in claim 22, including means on said container support means and said frame engagable for releasably securing said container support means in at least two longitudinally adjusted positions.

24. The car claimed in claim 23, said container support means spaced from said combined hitch and bolster means being movable to an inactive position.

25. The car claimed in claim 22, said platform means comprising deck plates each having a longitudinally extending slot formed therein, said container supports including bolt means adapted to extend into respective ones of said slots, whereby said supports can be adjusted longitudinally of said centersill.

26. The car claimed in claim 22, wherein said container supports each include upstanding flanges adjacent said planar surfaces, disposed parallel to said centersill when said container supports are in position to permit disposition of a container between said flanges on said planar surfaces.

27. The car claimed in claim 23, said means on said container support means and said frame including projections on said container supports and transverse slot defining means on said deck plates to receive said projections.

28. The car claimed in claim 20, wherein said combined hitch and bolster means is movable longitudinally relative to said frame, and cushioning means interposed between said combined hitch and bolster means and said frame is operable to cushion lading in the trailer or container against longitudinal forces imparted to said frame.

29. The car claimed in claim 28, said cushioning means including staged first and second cushioning means said first cushioning means being operable to bias said combined hitch and bolster means toward a neutral position and to cushion said combined hitch and bolster means in both directions of movement longitudinal relative to said frame, said second cushioning means including lost motion means whereby to cushion said combined hitch and bolster means in both directions of movement longitudinally relative to said frame only after a predetermined amount of relative movement therebetween.

30. The car claimed in claim 29, said second cushioning means including rubber blocks fixed to said frame and to means connected to said combined hitch and bolster means and adapted to deflect in shear after said predetermined amount of relative movement.

31. The car claimed in claim 29, said first cushioning means including compression spring means interposed between said frame and said combined hitch and bolster means.

32. The car claimed in claim 31, wherein said first cushioning means includes a pair of cushioning devices defining hollow tubular housings secured to said frame, coacting shafts connected to said combined hitch and bolster means and compression springs interposed between said hollow tubular housings and said shafts to compress said springs upon either direction of movement of said combined hitch and bolster means.

33. The car as claimed in claim 32 wherein said cushioning devices each include annular end caps at opposite ends thereof, hollow sleeve members with flanged ends disposed internally of said tubular members, said sleeve members extending outwardly of said tubular members through said annular end caps and terminating in free ends external thereto, spring means disposed intermediate said flanges on said sleeves urging said sleeves toward said end caps, each one of said coacting shafts extending through one of said tubular members, the sleeve members thereof, and spring means thereof and terminating adjacent opposite ends in collars, each said collar being cooperable with one of said sleeve members on impact to said frame to urge said sleeve member toward the other sleeve member within said tubular member to compress said springs between said internal flanges on said sleeve members.

34. A car as claimed in claim 28, wherein said cushioning means includes a pair of cushioning devices defining hollow tubular housings secured to said frame, coacting shafts connected to said combined hitch and bolster means and compression springs interposed between said hollow tubular housings and said shafts to compress said springs upon either direction of movement of said combined hitch and bolster means.

35. The car as claimed in claim 34 wherein said cushioning devices each include annular end caps at opposite ends thereof, hollow sleeve members with flanged ends disposed internally of said tubular members, said sleeve members extending outwardly of said tubular members through said annular end caps and terminating in free ends external thereto, spring means disposed intermediate said flanges on said sleeves urging said sleeves toward said end caps, each one of said coacting shafts extending through one of said tubular members, the sleeve members thereof, and the spring means thereof, and terminating adjacent opposite ends in collars, each said collar being cooperable with one of said sleeve members on impact to said frame to urge said sleeve member toward the other sleeve member within said tubular member to compress said springs between said internal flanges on said sleeve members.

36. A car as claimed in claim 28, wherein said frame includes tracks mounted thereon and said combined hitch and bolster means includes slides slidably received within said tracks.

* * * * *